US008497890B2

(12) United States Patent
Gu et al.

(10) Patent No.: US 8,497,890 B2
(45) Date of Patent: Jul. 30, 2013

(54) THERMAL PRINT HEAD DETECTING DEVICE AND DETECTING METHOD, AND A HEAT PRINTER USING THE SAME

(75) Inventors: Changgang Gu, Shandong (CN); Zhigang Xu, Shandong (CN); Guangdong Hu, Shandong (CN); Yuguo Wang, Shandong (CN); Xiangang Yang, Shandong (CN)

(73) Assignee: Shandong New Beiyang Information Technology Co., Ltd, Weihai, Shandong (CN)

( * ) Notice: Subject to any disclaimer, the term of this patent is extended or adjusted under 35 U.S.C. 154(b) by 102 days.

(21) Appl. No.: 13/139,104

(22) PCT Filed: Nov. 25, 2009

(86) PCT No.: PCT/CN2009/075124

§ 371 (c)(1),
(2), (4) Date: Jun. 10, 2011

(87) PCT Pub. No.: WO2010/066162

PCT Pub. Date: Jun. 17, 2010

(65) Prior Publication Data

US 2011/0242254 A1 Oct. 6, 2011

(30) Foreign Application Priority Data

Dec. 12, 2008 (CN) ..... 2008 1 0172780

(51) Int. Cl.
*B41J 2/32* (2006.01)

(52) U.S. Cl.
USPC ..... 347/171; 347/192

(58) Field of Classification Search
USPC ..... 347/171, 192
See application file for complete search history.

(56) References Cited

U.S. PATENT DOCUMENTS 4,500,893 A * 2/1985 Sakura et al. ..... 347/211
4,774,526 A * 9/1988 Ito ..... 347/171

FOREIGN PATENT DOCUMENTS

JP 60-092875 * 5/1985
JP 60-92876 5/1985

(Continued)

OTHER PUBLICATIONS

International Search Report for PCT/CN2009/075124, Feb. 11, 2010.

*Primary Examiner* — Huan Tran
(74) *Attorney, Agent, or Firm* — Harrity & Harrity, LLP

(57) ABSTRACT

A thermal print head detecting device comprises a power supply (1), a power supply switch (4), a power supply switch control circuit (5), a first detecting resistor (Ra), a second detecting resistor (Rb), a print head (2) to be detected and a print head control circuit (3); an output end of the power supply (1) is connected to a common joint (N) of respective heating elements of the print head through the power supply switch (4), the first detecting resistor (Ra) is connected in parallel with the power supply switch (4); an output end of the power supply switch control circuit (5) is connected to a control end of the power supply switch (4); the second detecting resistor (Rb) has one end connected to the common joint (N) of the heating element units, and the other end grounded; and the print head control circuit (3) controls strobing of each heating element unit of the print head. The thermal print head detecting device does not need an exclusive power supply, which prominently simplifies the circuit of the detecting device and decreases the cost.

11 Claims, 4 Drawing Sheets

FOREIGN PATENT DOCUMENTS

| | | |
|---|---|---|
| JP | 60-159662 | 8/1985 |
| JP | 3-193367 | 8/1991 |
| JP | 2007-268918 | 10/2007 |
| JP | 2008-194869 | 8/2008 |

* cited by examiner

THERMAL PRINT HEAD DETECTING DEVICE AND DETECTING METHOD, AND A HEAT PRINTER USING THE SAME

This application claims the priority of Chinese Patent Application No. 200810172708.2 filed with the Chinese Patent Office on Dec. 12, 2008 and entitled "A Thermal Print head Detecting Device and Detecting Method and a Heat Printer Using the Same", and the entire content of which is incorporated herein by reference.

FIELD OF THE INVENTION

The present invention relates to the technology of thermal printer, and in particular, to a thermal print head detecting device. Moreover, the present invention also provides a detecting method for detecting a thermal print head using the thermal print head detecting device. The present invention further provides a heat printer using the above thermal print head detecting device and method.

BACKGROUND OF THE INVENTION

The thermal print head is an important part of the heat printer and used in thermal printer, thermal transfer printer and other heat printer. The thermal print head is provided with heating element units, and corresponding graphs or characters can be printed by controlling whether each unit generates heat. Particularly, the thermal printer, making use of the heating element of the print head generating heat, enables a chemical change of a thermo-sensitive layer on the surface of the printing paper, so as to develop colors and form characters or images, while the thermal transfer printer, making use of the heating element of the print head generating heat, heats up and melts the pigment matters on the carbon ribbon onto the surface of the printing paper to form characters or images.

Take the commonest thermal printer as an example. The heating element units of the thermal print head used are heatable square dots, and one thermal print head has 320 heatable square dots each occupying an area of 0.25 mm*0.25 mm. In printing, corresponding heatable square dots in the dot matrix are controlled to generate heat according to the characters and images to be printed, and then the contents to be printed may be printed on any place of the thermal printing paper. The aforesaid heating element units are represented as resistance in electrical characteristic.

Obviously, normal printing will be affected if any heating element unit of the thermal print head cannot normally generate heat when a failure such as open circuit occurs. Generally, however, when an individual heating element unit of the thermal print head fails to normally generate heat, the influence to printing cannot be instantly recognized by observing the printing effect, while such failure might have significant influence in some printing occasions. For instance, the heat printer is usually used to print the bar code. The bar code which is compiled with bars and gaps having different widths and different reflectivities according to a certain encoding rule can express information such as a group of numbers or letter symbols, and is used in various occasions such as commodity and printed work identification. When the heat printer is used for printing, according to requirements of bar code encoding, corresponding bars and gaps are formed on the printing medium by controlling whether each heating element unit of the thermal print head generates heat. If a certain heating element unit of the thermal print head is broken or damaged, this heating element unit cannot generate heat after it is galvanized, resulting in inability of color development of the dot corresponding to this heating element unit. Thus, when the bar code is printed, the arranging rule of the bars and gaps of the bar code is changed by the blank bar generated at the place corresponding to the broken heating element, which leads to a data error. As the data information represented by the bar code is very important, and the above error occurring in printing is hard to be detected, measures therefore are necessarily to be employed to avoid the error.

Owing to the above reason, the heat printer usually detects the heating element units of the thermal print head. A traditional method is to regularly remove the print head from the printer and to detect the resistance value of the heating element units of the thermal print head using an exclusive detecting circuit. As the periodic detection cannot timely reflect the on or off state of the heating element unit of the print head, and the print head should be removed, and the operation is complicated, therefore, practical requirements cannot be satisfied.

Japanese Patent publication No. JP2007-268918 discloses a thermal print head detecting device. FIG. 1 is a circuit principle diagram of the thermal print head detecting device provided in this Japanese Patent. A control device of the thermal print head detecting device includes a normal printing power supply and an open circuit detecting power supply 21. When the printer receives a printing instruction, a power supply shifting switch 22 turns on the normal printing power supply; and when the printer receives a detecting instruction, the power supply shifting switch 22 turns on the open circuit detecting power supply 21. A print head heating element unit HE is connected in parallel with a resistor 25, with the parallel end being connected to an output end of the power supply shifting switch 22 through a resistor 23 and the other end being grounded. A detecting circuit is constructed with the turned-on open circuit detecting power supply 21, the resistor 23, the heating element unit HE and the detecting resistor 25. In detection, the heating element unit HE can be judged whether it is broken by detecting a voltage of the resistor 23. Thus, the on or off state of the heating element unit of the print head can be detected on line by shifting between the normal printing power supply and the open circuit detecting power supply.

The shortcomings of the prior art above lie in: the normal printing power supply and the print head detecting power supply should be separately provided and the power supply switch should be provided for this two power supplies, which make the circuit complex. Moreover, if a too small resistance value is set for the resistor 23 and the resistance value of the heating element unit is imprecisely detected, the existing failure may be hardly discovered; and if a too high resistance value is set for the resistor 23, the resistor 23 will consume too much power in normal printing, and the printing effect will be affected.

SUMMARY OF THE INVENTION

Upon considering the above shortcomings, the technical problem to be solved by the present invention is to provide a thermal print head detecting device having a simple structure, high precision and capability of performing real-time detection.

The print head detecting device provided in the present invention comprises a power supply, a power supply switch, a power supply switch control circuit, a first detecting resistor, a second detecting resistor, a print head to be detected and a print head control circuit; an output end of the power supply being connected to a common joint of a heating element units of the print head through the power supply switch, the first detecting resistor being connected in parallel with the power supply switch; an output end of the power supply switch control circuit being connected to a control end of the power supply switch; one end of the second detecting resistor connected to the common joint of the heating element units and the other end of the second detecting resistor grounded; and the print head control circuit controlling strobing of each heating element unit of the print head.

Preferably, a resistance value of the second detecting resistor is far bigger than a resistance value of the heating element unit of the print head.

Preferably, a resistance value of the first detecting resistor is far bigger than a resistance value of the heating element unit of the print head.

Preferably, the resistance value of the second detecting resistor specifically is more than five times of a resistance value of the heating element unit of the print head.

The present invention further provides a thermal print head detecting method adapted to the thermal print head detecting device according to any one of the above preferred solutions, including: turning off the power supply switch, performing detection of a resistance value of the thermal print head, and turning off the power supply switch, the thermal print head performing a printing.

Preferably, after the power supply switch is turned off, a certain heating element unit of the print head is strobed, and then a voltage $U_A$ of the common joint of the heating element units of the print head, or a voltage or current of the first detecting resistor or a voltage or current of the second detecting resistor is detected and obtained, and the detected numerical value is taken as a judging standard to be compared with a normal numerical value obtained through calculation so as to judge whether it is within an error range of the normal numerical value, if yes, the resistance value of the heating element unit is judged to be normal, and if not, the resistance value of the heating element unit is judged to be abnormal; states of resistance values of respective heating element units are detected one by one by repeating the above steps, then, the state of the resistance value of the thermal print head can be obtained.

Preferably, when the voltage $U_A$ of the common joint of the heating element units of the print head is specifically taken as the judging standard, specific steps for detecting a state of a resistance value of a certain heating element unit are as follow:

step 1, turning off the power supply switch;

step 2, strobing a heating element unit to be detected;

step 3, measuring the voltage $U_A$ of the common joint of the heating element units of the print head; and step 4, comparing the voltage $U_A$ measured with a theoretical voltage value, when one heating element unit is strobed, of the point, i.e. comparing the voltage $U_A$ measured with a numerical range of a strobing voltage $V_{TPH_ONE}$ of a single heating element unit, to judge whether it is within the numerical range, if yes, the resistance value of the heating element unit is judged to be normal; and if not, the resistance value of the heating element unit is judged to be abnormal.

Preferably, the following step is further included:

comparing the detecting voltage $U_A$ of a middle point detected and obtained with a numerical range of a turn-off voltage $V_{TPH_OFF}$ of the heating element units determined in advance, if $U_A$ is within the numerical range, the detected heating element unit is judged to be broken.

The present invention further provides a heat printer using the thermal print head detecting device and a heat printer using the thermal print head detecting method.

Compared with the prior art, the thermal print head detecting device in the present invention is provided with the first detecting resistor connected in parallel with the power supply switch. When the thermal print head works normally, the first detecting resistor is short-circuited by the power supply switch and has no function; and when the heating element units of the thermal print head are detected, the power supply switch is turned off, electrical current can flow to the heating element units of the thermal print head only by passing through the first detecting resistor. Thus, when the same voltage is supplied, the currents flowing through the heating element units of the thermal print head in the detecting state and in the printing state may be greatly different. In the prior art, an exclusive power supply should be provided in order to control the current flowing through the heating element units in detection, while the present invention does not need such exclusive power supply, which prominently simplifies the circuit of the detecting device and decreases the cost.

In a preferred embodiment of the present invention, the second detecting resistor whose resistance value is far bigger than that of the heating element unit of the thermal print head is chosen. Thus, when the detection is performed, the on and off of the heating element unit of the print head greatly affect the bases according to which the judgment is made, such as the voltage $U_A$ of the common joint of the heating element units of the print head, or the voltage or current of the first detecting resistor, or the voltage or current of the second detecting resistor, so that a distinction is easily made. Likewise, as the resistance value of the second detecting resistor is quite big, the current divided by the second detecting resistor is made quite small when the print head works, then the power consumed by the second detecting resistor is quite low and not too much power will be lost.

In another preferred embodiment of the present invention, the first detecting resistor whose resistance value is far bigger than that of the heating element unit of the print head is chosen. Thus, when the detection is performed, the on and off of the heating element unit of the print head may be effectively distinguished in detection by using a quite small detecting current, even using a drain current of the power supply, and the detecting result is obtained. The preferred embodiment further decreases the current loss during detection and avoids the damage to the heating element unit of the thermal print head when it generates heat in the detection.

The print head detecting method provided in the present invention is capable of effectively detecting whether the resistance value of the heating element unit of the print head are normal or not by using the above device, and the further preferred solution thereof is capable of further judging whether the heating element unit of the print head is broken by comparing the voltage $U_A$ of the common joint of the heating element units of the print head with the numerical range of the turn-off voltage $V_{TPH_OFF}$ of the heating element unit determined in advance.

DETAILED DESCRIPTION OF EMBODIMENTS

Figure 1:
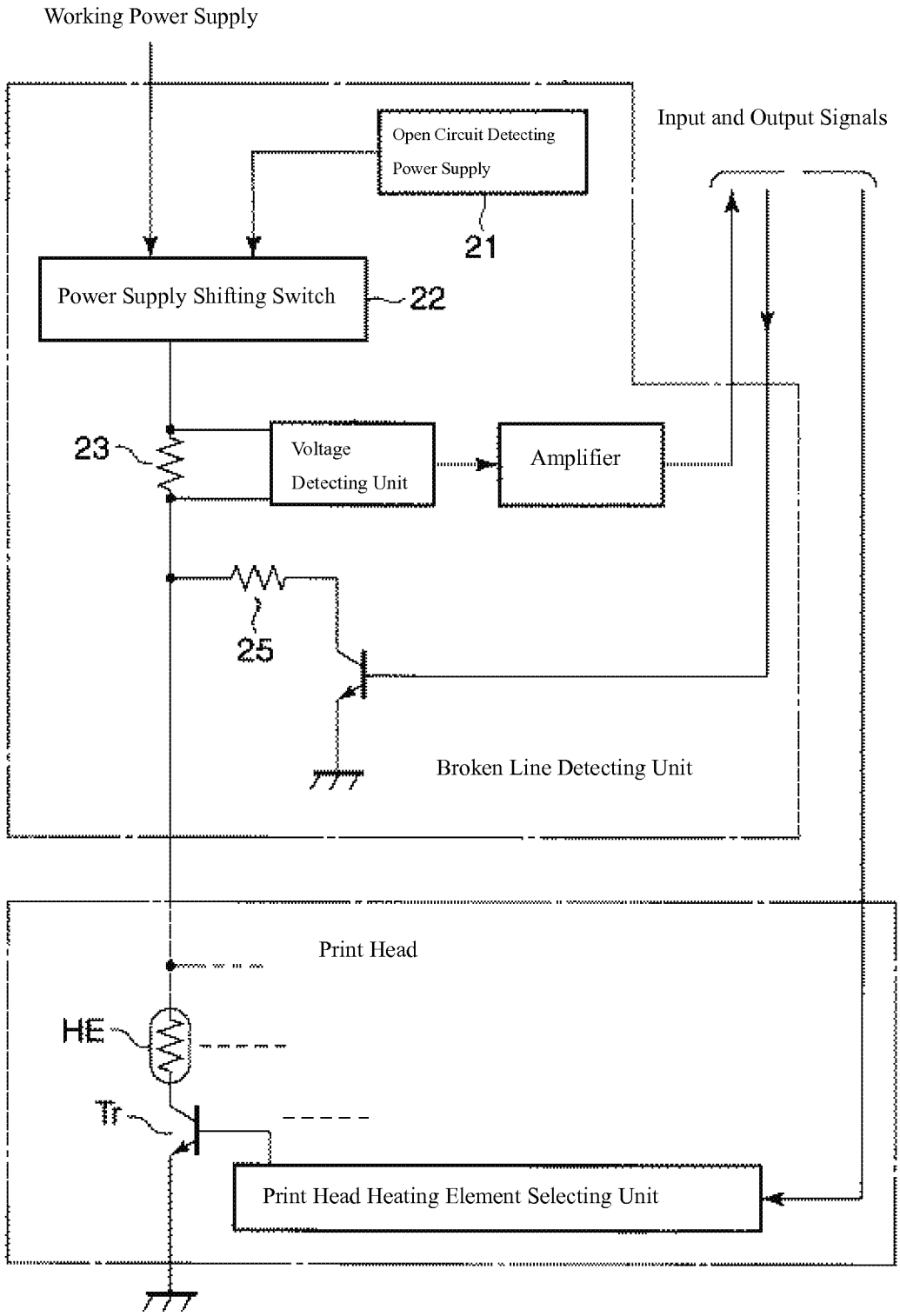
FIG. 1 is a thermal print head detecting device disclosed by Japanese Patent publication No. JP2007-268918.
Figure 2:
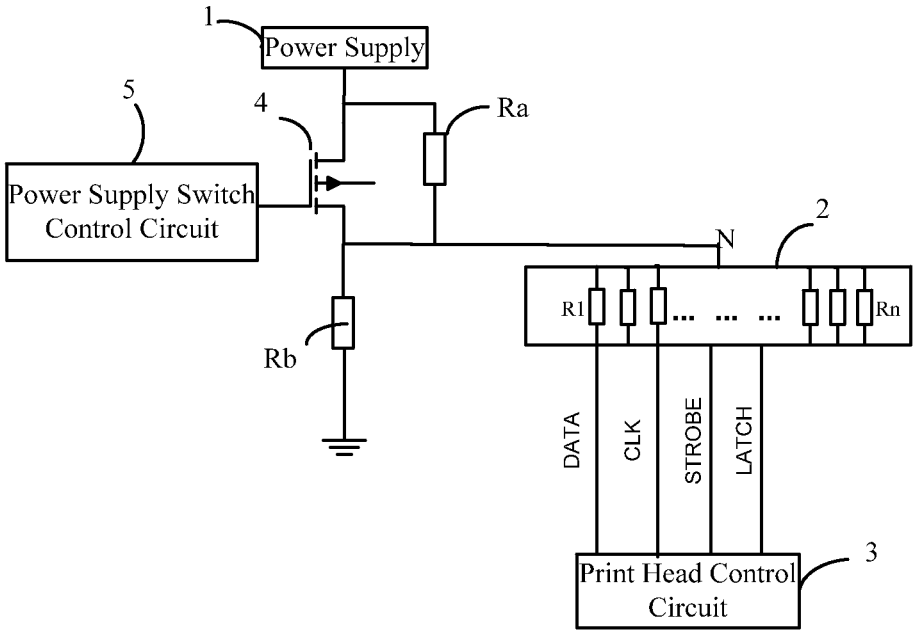
FIG. 2 is a circuit principle diagram of a thermal print head detecting device provided in a first embodiment of the present invention.

Please refer to FIG. 2, a circuit principle diagram of a thermal print head detecting device provided in a first embodiment of the present invention. It should be indicated that the circuit shown in FIG. 2 is called the circuit principle diagram of the thermal print head detecting device, since the present invention merely focuses on the problem of detecting the thermal print head. As a matter of fact, this circuit at the same time controls the thermal print head in normal work.

As shown in FIG. 2, the thermal print head detecting device includes a power supply 1, a print head 2, a print head control circuit 3, a power supply switch 4, a power supply switch control circuit 5, a first detecting resistor Ra, and a second detecting resistor Rb.

The power supply 1 is configured to provide a voltage, such as a voltage of 24V, needed by the print head 2 for normal printing. Moreover, the power supply 1 also acts as a power supply voltage when detection is performed, i.e. there is no need to exclusively provide a detecting power supply for the detection in the present embodiment.

The print head 2 includes an array of heating element consisting of a plurality of heating element units. The other portions of the print head 2 are not considered as the present device is configured to detect the working conditions of the heating element units. Each heating element unit is equivalent to a resistor, and n heating element units consisting the heating element have a common joint N connecting each other and connected to a positive pole of the power supply, and the other ends of the heating element units are called strobing ends grounded through strobing switches (not shown in the figure) corresponding to respective heating element units. In printing, the heating element units are controlled to generate heat, in fact, controlled whether a current flows through by controlling on and off of the above strobing switches respectively provided by corresponding heating element units. Of course, the common joint N also may be grounded, while the strobing ends of respective heating element units are connected to the positive pole of the power supply through respective strobing switches. The specific connecting method brings no essential difference hereto. The present embodiment merely describes the situation that the common joint N of the heating element units is connected to the positive pole of the power supply.

The print head control circuit 3 is connected with the print head 2 through a data bus DATA, a clock bus CLK, a strobing bus STROBE and a data latch line LATCH. A signal output by the print head control circuit 3 may control on and off of the strobing switches of respective heating element units. When the strobing switch corresponding to a certain heating element unit is turned on, this heating element unit is regarded as being strobed. The contents to be printed may be controlled by strobing different heating element units.

The power supply switch 4 is connected between a power supply output end of the power supply 1 and the common joint of the heating element units. This power supply switch 4 has a control end and may be controlled to be turned on or turned off by applying a high level or a low level to the control end. The power supply switch 4 specifically may be realized by choosing a switch triode, thyristor, relay, etc.

An output end of the power supply switch control circuit 5 is connected to the control end of the power supply switch 4, and the power supply switch control circuit 5 receives a control signal sent by a control part of the printer, and accordingly outputs a corresponding high or low level from its output end to control the power supply switch 4 to be turned on or turned off.

The first detecting resistor Ra is connected between the power supply output end of the power supply 1 and the common joint of the heating element units, i.e. the first detecting resistor Ra is connected in parallel with the power supply switch 4.

The second detecting resistor Rb has one end connected to the common joint of the heating element units and the other end grounded; the resistance value of the second detecting resistor Rb is far bigger than that of the heating element unit. By the phrase "far bigger than", it means that a bypassing function of the second detecting resistor Rb to the heating element unit may be neglected, i.e. the current output by the power supply 1 may be regarded as completely passing through the heating element unit and flowing to a grounding end. For example, the resistance value of the second detecting resistor Rb is more than ten times of the resistance value of the heating element unit.

Next, the working principle of the device will be explained.

Figure 3:
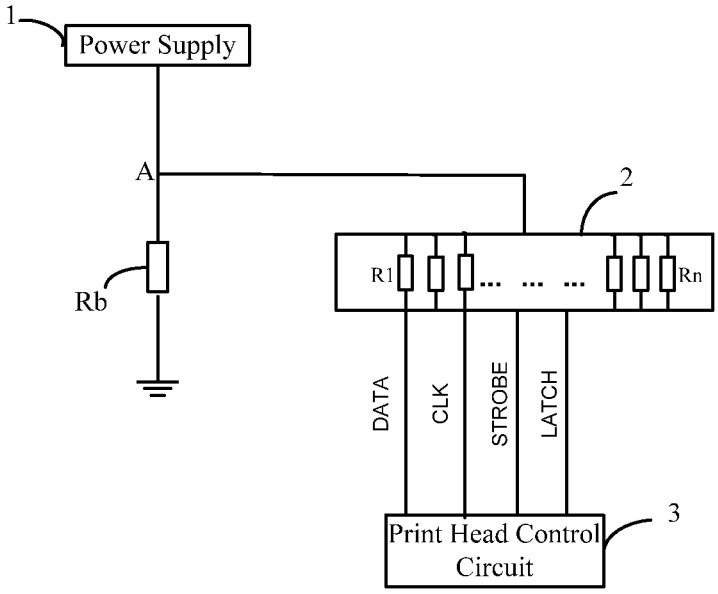
FIG. 3 is an equivalent circuit diagram of the thermal print head detecting device in the case of a power supply switch of which is turned on, provided in the first embodiment of the present invention.

When the printer needs to print, the control part of the printer sends an instruction to the power supply switch control circuit 5 to indicate it to control the power supply switch 4 to be turned on. The power supply switch control circuit 5 outputs from its output end a high level (or a low level) controlling the power supply switch 4 to be turned on to enable the power supply switch 4 to be turned on, and the voltage at the output end of the power supply 1 is supplied to the common joint N of the heating element units through the power supply switch 4. In this state, the first detecting resistor Ra is broken by the power supply switch 4, i.e. the first detecting resistor Ra has no function to the power supply to the print head, allowing possible simplification of the device circuit to be a circuit as shown in FIG. 3. At this moment, the print head control circuit 3 strobes the heating element unit that needs to generate heat through four output lines thereof according to the instruction provided by the control part of the printer. The voltage output by the power supply 1 passes through all the strobed heating element units and flows to the grounding end to enable the current to pass through these heating element units which will generate heat, finally realizing desired printing effect. The second detecting resistor Rb in this state is equivalently to be connected in parallel with the strobed heating element units, and as the resistance value of the second detecting resistor Rb is bigger than that of the heating element unit, the current passing through the second detecting resistor Rb is quite small, and little electrical energy will be lost.

Figure 4:
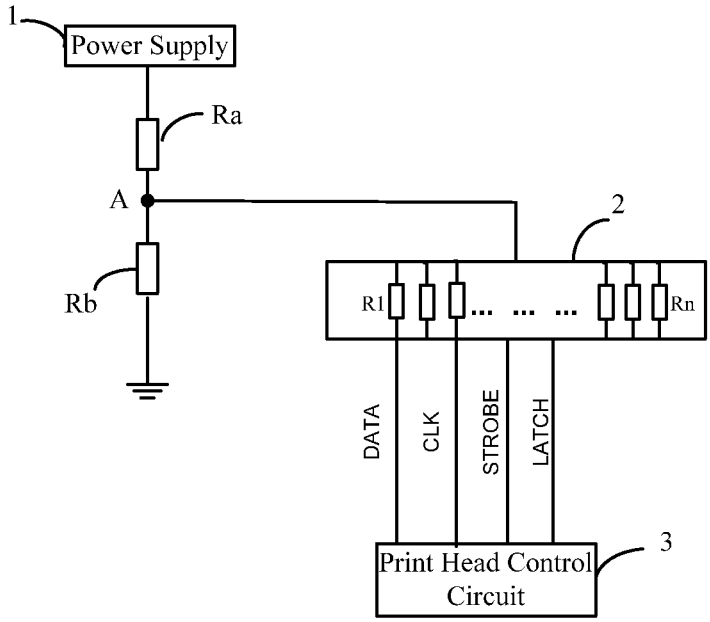
FIG. 4 is an equivalent circuit diagram of the thermal print head detecting device in the case of the power supply switch of which is turned off, provided in the first embodiment of the present invention.

When the thermal print head detecting device needs to be detected, the control part of the printer sends an instruction to the power supply switch control circuit 5 to indicate it to control the power supply switch 4 to be turned off. When the power supply switch 4 is turned off, the second detecting resistor Rb, after being connected in parallel with the heating element units, is connected in series with the first detecting resistor Ra. The first detecting resistor Ra is set to be sufficiently big, then, a quite small detecting circuit current may be chosen. The current passing through the strobed heating element unit is quite small during the detection, and will not be enough to cause the heating element unit to generate heat. In a situation that the first detecting resistor Ra is sufficiently big, the power supply 1 is directly enabled to be in state of not supplying power externally, and the detection may be implemented by merely using a drain current thereof. In the above state, the device circuit may be simplified into a circuit shown in FIG. 4. At this moment, the print head control circuit 3 strobes respective heating element units one by one in turn through four output lines thereof according to the instruction provided by the control part of the printer. The current output by the power supply 1 passes through the strobed heating element unit and flows to the grounding end. The second detecting resistor Rb is equivalent to be in a state of connected in parallel with the strobed heating element unit. At this time, a voltage of a middle point A between the first detecting resistor Ra and the second detecting resistor Rb is detected. Assume that the heating element unit being currently detected work normally, as the resistance value of the heating element unit is far smaller than that of the second detecting resistor Rb, a strobing voltage $V_{TPH_ONE}$ of a single heating element unit of the middle point A mainly depends upon the heating element unit being currently detected. Comparing this voltage with a turn-off voltage $V_{TPH_OFF}$ of the heating element units of the middle point A when no heating element unit is strobed, $V_{TPH_ONE} << V_{TPH_OFF}$ If the heating element unit or a circuit supplying power thereto failed, after this heating element unit is strobed, its resistance value is obviously different from that in normal work, and an extreme ease is that subcircuits of the heating element unit is totally not turned on. In this case, the detecting voltage of the middle point A is obviously quite different from the strobing voltage $V_{TPH_ONE}$ of the single heating element unit in normal work. Therefore, the state of the heating element unit being currently detected may be judged according to the detecting voltage of the middle point A.

Figure 5:
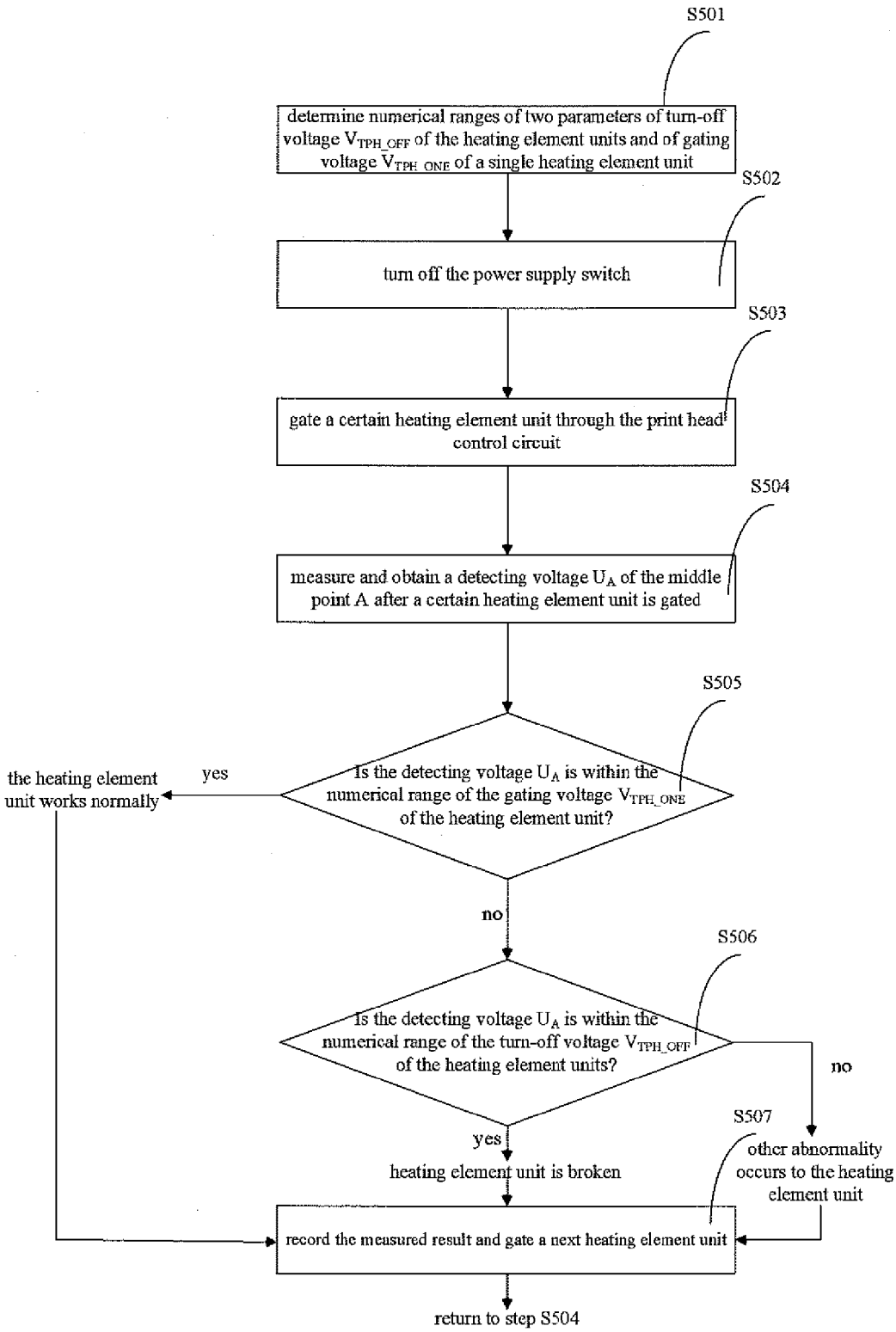
FIG. 5 is a flow chart of detecting steps of detecting heating element units in the first embodiment of the present invention.

A method for judging the state of the heating element unit according to the detecting voltage of the middle point A is as shown in FIG. 5. Prior to performing the judgment, numerical ranges of two parameters which are the turn-off voltage $V_{TPH_OFF}$ of the heating element units and the strobing voltage $V_{TPH_ONE}$ of the single heating element unit have been determined. Specifically, numerical values of the two parameters which are the turn-off voltage $V_{TPH_OFF}$ of the heating element units and the strobing voltage $V_{TPH_ONE}$ of the single heating element unit may be calculated theoretically or according to practical detecting results. Besides, appropriate error ranges also should be set for the two parameters according to design requirements. The numerical ranges of the two parameters can be determined in conjunction with data in the two steps above.

Step S501, start.

Step S502, turn off the power supply switch.

Step S503, strobe a certain heating element unit to be detected through the print head control circuit 3.

Step S504, measure and obtain a voltage $U_A$ of the common joint A of the heating elements units of the print head after a certain heating element unit is strobed.

Step S505, compare the measured voltage $U_A$ with the numerical range of the strobing voltage $V_{TPH_ONE}$ of the single heating element unit determined prior to step S501 to judge whether $U_A$ is within the numerical range. If yes, corresponding heating element unit is judged to work normally, and go to next step S507; if not, the heating element unit is judged to work abnormally, and go to next step S506.

Step S507, record the measured result and strobe a next heating element unit, and return to step S504 until all the heating element units are detected.

In step S505, if the heating element unit is judged to work abnormally, the measured voltage $U_A$ also may be compared with the numerical range of the turn-off voltage $V_{TPH_OFF}$ of the heating element units determined prior to step S501; if the turn-off voltage $V_{TPH_OFF}$ is within the numerical range, the heating element unit is judged to be broken, and go to step S506; if not, other abnormality is judged to occur to the heating element unit. The abnormality type of the heating element unit may be determined via the judgment and more information is provided for repair Through the above steps, all the heating element units of the heating element of the print head 2 may be detected one by one to obtain the situation of working state of each heating element unit. After the detection is completed, a detecting report may be generated according to the detecting results for use in the printer maintenance.

Though the thermal print head is detected by detecting the detecting voltage $U_A$ of the point A in the embodiment, the state of the heating element units of the print head actually also may be judged by detecting voltages or currents at both ends of Ra.

An embodiment of a heat printer using the present thermal print head detecting device can be obtained just by applying the above thermal print head detecting device to a printer such as thermal printer or thermal transfer printer. Unnecessary details will not be given herein.

Above description is only to illustrate the preferred embodiments of the present invention. It should be indicated that the person ordinarily skilled in the art also may make various improvements and modifications without departing from the principle of the present invention. These improvements and modifications also should be concluded in the scope protected by the present invention.

What is claimed is:

1. A thermal print head detecting device, comprising a power supply, a power supply switch, a power supply switch control circuit, a first detecting resistor, a second detecting resistor, a print head to be detected and a print head control circuit; wherein an output end of the power supply is connected to a common joint of respective heating element units of the print head through the power supply switch, the first detecting resistor is connected in parallel with the power supply switch; an output end of the power supply switch control circuit is connected to a control end of the power supply switch; one end of the second detecting resistor is connected to the common joint of the heating element units and the other end of the second detecting resistor is grounded; and the print head control circuit controls strobing of respective heating element units of the print head, wherein a resistance value of the second detecting resistor is bigger than a resistance value of the heating element unit of the print head.

2. The thermal print head detecting device according to claim 1, wherein a resistance value of the first detecting resistor is bigger than a resistance value of the heating element unit of the print head.

3. The thermal print head detecting device according to claim 1, wherein a resistance value of the second detecting resistor specifically is more than five times of a resistance value of the heating element unit of the print head.

4. A thermal print head detecting method, adapted to the thermal print head detecting device according to claim 1, wherein, turning off the power supply switch, and performing detection of a resistance value of the thermal print head; and turning on the power supply switch, and the thermal print head performing a printing.

5. The thermal print head detecting method according to claim 4, wherein after the power supply switch is turned off, a certain heating element unit of the print head is strobed, after the strobing, a voltage $U_A$ of a common joint of the heating element units of the print head, or a voltage or a current of the first detecting resistor, or a voltage or a current of the second detecting resistor is detected and obtained, and a detected numerical value is taken as a judging standard to be compared with a normal numerical value obtained through calculation so as to judge whether it is within an error range of the normal numerical value, if yes, the resistance value of this heating element unit is judged to be normal; and if not, the resistance value of this heating element unit is judged to be abnormal; states of resistance values of respective heating element units are detected one by one by repeating above steps, then, the state of the resistance value of the thermal print head can be obtained.

6. The thermal print head detecting method according to claim 5, wherein when the voltage $U_A$ of the common joint of the heating element units of the print head is taken as the judging standard, steps for detecting a state of a resistance value of a certain heating element unit are as follows:

step 1, turning off the power supply switch;

step 2, strobing a heating element unit to be detected;

step 3, measuring the voltage $U_A$ of the common joint of the heating element units of the print head; and step 4, comparing the voltage $U_A$ measured with a theoretical voltage value of a point at which one heating element unit is strobed, i.e, comparing the voltage $U_A$ measured with a numerical range of a strobing voltage $V_{TPH_ONE}$ of a single heating element unit, to judge whether $U_A$ is within the numerical range, if yes, the resistance value of the heating element unit is judged to be normal; and if not, the resistance value of the heating element unit is judged to be abnormal.

7. The thermal print head detecting method according to claim 6, wherein the method further include a step of comparing the voltage $U_A$ and obtained with a numerical range of a turn-off voltage $V_{TPH_OFF}$ of the heating element units determined in advance, if $U_A$ is within the numerical range, the detected heating element unit is judged to be broken.

8. A heat printer, having the thermal print head detecting device according to claim 1.

9. A heat printer, using the thermal print head detecting method according to claim 4.

10. The thermal print head detecting device according to claim 1, wherein a resistance value of the first detecting resistor is bigger than a resistance value of the heating element unit of the print head.

11. The thermal print head detecting device according to claim 1, wherein a resistance value of the second detecting resistor specifically is more than five times of a resistance value of the heating element unit of the print head.

* * * * *